US005686081A

United States Patent [19]

Ono et al.

[11] Patent Number: 5,686,081

[45] Date of Patent: Nov. 11, 1997

[54] DIVIDED PACKAGE OF ADSORBENT FOR INTERNAL USE

[75] Inventors: Saichi Ono, Tokyo; Tadahiko Chiba, Yono; Yasuo Uehara, Iruma, all of Japan

[73] Assignee: Kureha Kagaku Kogyo Kabushiki Kaisha, Japan

[21] Appl. No.: 618,336

[22] Filed: Mar. 19, 1996

Related U.S. Application Data

[63] Continuation of Ser. No. 116,768, Sep. 7, 1993, abandoned.

[30] Foreign Application Priority Data

Sep. 8, 1992 [JP] Japan ..... 4-264169

[51] Int. Cl.[6] ..... A61K 9/00; A61K 33/44; B65D 1/09

[52] U.S. Cl. ..... 424/400; 206/528; 206/530; 206/532

[58] Field of Search ..... 424/400; 206/528, 206/530, 532

[56] References Cited

U.S. PATENT DOCUMENTS 4,642,239 2/1987 Ferrar et al. .

4,681,764 7/1987 Endo et al. ..... 424/125

FOREIGN PATENT DOCUMENTS

| | | |
|---|---|---|
| 56905/80 | 3/1980 | Australia . |
| 0 192 417 | 8/1986 | European Pat. Off. . |
| 0 216 509 | 4/1987 | European Pat. Off. . |
| 0 361 711 | 4/1990 | European Pat. Off. . |
| 1 079 195 | 4/1953 | France . |
| 28 00548 | 7/1979 | Germany . |
| 35 35 957 | 4/1987 | Germany . |
| 38 28 847 | 3/1990 | Germany . |
| 2 145 686 | 4/1985 | United Kingdom . |

OTHER PUBLICATIONS

Japanese Patent Publication (Kokoku) No. 62–11611 (1987).

*Primary Examiner*—John M. Cooney, Jr.
*Attorney, Agent, or Firm*—Nixon & Vanderhye

[57] ABSTRACT

Disclosed herein are a divided package of a medicinal adsorbent for internal use, comprising a divided package bag and an adsorbent for internal use which releases air ranging from 1.3 to 10 ml based on one gram of the adsorbent on heating from 10° C. to 30° C. and is packed therein, and having a volume expansion coefficient ranging from 0 to 0.064 ml/°C.·g (adsorbent for internal use) at a temperature of from 10° to 30° C., and a process for producing the same.

4 Claims, 2 Drawing Sheets

DIVIDED PACKAGE OF ADSORBENT FOR INTERNAL USE

This is a continuation of application Ser. No. 08/116,768, filed 7 Sep. 1993, now abandoned.

BACKGROUND OF THE INVENTION

The present invention relates to a divided package of an adsorbent for internal use. Particularly, it relates to a divided package of an adsorbent for internal use, which is substantially proof against deformation due to change of the amount of air included in the adsorbent.

According to the Japanese Pharmacopoeia, there are the following four types of officially recognized containers for medicines: well-closed containers, tight containers, hermetic containers, and light-resistant containers.

The well-closed container protects the contents from extraneous solids and from loss of the articles under the ordinary or customary conditions of handling, shipment, storage and distribution. Examples of the containers are paper boxes, paper bags and the like.

The tight container protects the contents from contamination by extraneous liquids, solids or vapors, from loss of the articles and from efflorescence, deliquescence or evaporation under the ordinary or customary conditions of handling, shipment, storage and distribution. The containers are tubes, cans, divided packages, plastic bottles and the like.

The hermetic container is impervious to air or any other gas under the ordinary or customary conditions of handling, shipment, storage and distribution. The containers are glass ampules, vials and the like.

The light-resistant container protects the contents from the effects of light by virtue of the specific properties of the material of which it is composed, including any coating applied to it. The containers include colored glass containers for injections.

The oral preparations such as tablets, capsules, powders and granules are preserved in the well-closed containers or tight containers. It is prescribed in the Pharmacopoeia that activated charcoal, which is a typical example of medicinal adsorbents for internal use, be preserved in well-closed containers.

Conventional activated charcoal is low in adsorptivity in the presence of bile acid and shows adsorptivity even on the beneficial substances in the body, such as digestive enzymes, etc., and its administration to human tends to cause constipation.

A new type of medicinal adsorbents for internal use which is free from the various defects of conventional activated charcoal such as mentioned above has been developed (Japanese Patent Publication No. 62-11611 and U.S. Pat. No. 4,681,764). The medicinal oral adsorbent disclosed in the above U.S. patent is a spherical carbonaceous adsorbent which is useful as an oral therapeutic agent for hepatopathy and nephropathy and also known as an oral adsorbent AST-120 useful for the treatment of chronic renal failure (see Clinical Dialysis, Vol. 2, No. 3, pp. 119–124, 1986).

Adsorptivity of the spherical carbonaceous adsorbent is acquired by combining an oxidative heat-treatment and a reductive heat-treatment in addition to the ordinary activating treatment. Actually, activated carbon is first heat-treated in an oxidizing atmosphere and then subjected to a high-temperature heat-treatment in a nitrogen atmosphere. By these heat-treatments, the constitution of the functional groups such as acidic groups, basic groups, phenolic hydroxyl group and carboxyl group on the surface is regulated to a specific range. Adsorptivity of such spherical carbonaceous adsorbent lowers gradually when left in the air for a long time. Therefore, it is preferable for such an adsorbent to preserve in a tight container.

A typical example of the tight containers suited for preserving the granular substances such as the said spherical carbonaceous adsorbent is divided packages such as three-side seal package, four-side seal package, package with bottom, stick-like package, etc. The divided packages are unit packages of medicament suited for oral administration, and one to a few divided packages of medicament are taken at one time.

The divided packages of an ordinary medicament have presented no serious problem in practical use, because they were free from the phenomenon of expansion and shrinkage depending on an atmospheric temperature.

However, a divided package obtained by filling a spherical carbonaceous adsorbent in a divided package bag as a tight container and then sealing is subjected to volume expansion or shrinkage depending on the change of ambient temperature and may be deformed largely. An example of a volume expansion coefficient for the divided package is about 0.073 ml/°C.·g (adsorbent for internal use) at a temperature ranging from 10° to 30° C. This volume expansion or shrinkage occurs in a short period of time, and reaches equilibrium in from a few seconds to a few minutes. Therefore, even a paper material through which air can pass relatively freely, such as woodfree paper, paraffin paper, patronen paper and the like, is not free from the effect of the said phenomenon, and a divided package made by using such paper is subjected to deformation depending on the change of ambient temperature. It is presumed that the air content included in a spherical carbonaceous adsorbent changes largely depending on the temperature since a lot of air can be included in it. For example, a spherical carbonaceous adsorbent releases about 1.46 ml of air per gram of adsorbent by raising a temperature from 10° to 30° C.

Such deformation of the divided packages causes troubles in casing, storage, transport, etc. Usually, a powder such as spherical carbonaceous adsorbent is packed into a dose in each divided package, and the divided packages containing the powder are packed in a paper case (outer case) and shipped. It sometimes happens that due to an unexpected volume expansion of the divided packages, it becomes unable to pack a prescribed number of divided packages in a case, or a design change of the outer case is required for containing a prescribed number of divided packages in the case. Enlargement of capacity of the case leads to an increase of freightage and other problems. Further, after the divided packages have been encased, the outer case may be deformed due to a volume expansion Of the divided packages. Reversibly, a large space may be generated in the case, causing disarrangement of the divided packages in the case, due to a volume shrinkage of the divided packages. Still further, when the ambient temperature elevates, there is the possibility of causing damage to the seal portion, break or pinhole formation of the divided packages, or other troubles, due to a volume expansion of the divided packages. The storage and transport of the divided packages is seriously hindered by these occurrences.

As the result of the present inventors strenuous researches for overcoming the above problems, it has been found that by using a divided package bag made of a film having a moisture permeability ranging from 0 to 20 $g/m^2 \cdot 24$ hr, and (a) filling an adsorbent for internal use heated to a temperature within the range from a 5° C. higher temperature than room temperature to 300° C. in the divided package bag and then sealing the divided package bag, or (b) filling an adsorbent for internal use in the divided package bag and then sealing the divided package bag under a pressure below the atmospheric pressure, the obtained divided package of adsorbent has a volume expansion coefficient from 0 to 0.064 ml/°C.·g (adsorbent) at a temperature from 10° to 30° C. and is substantially proof against deformation due to a change in amount of air included in the adsorbent for internal use depending on a change of ambient temperature. The present invention has been achieved on the basis of this finding.

SUMMARY OF THE INVENTION

An object of the present invention is to provide a divided package of a medicinal adsorbent for internal use, which the divided package is substantially proof against deformation due to a change in amount of air contained in the adsorbent in the divided package depending on the change of ambient temperature.

Another object of the present invention is to provide a divided package which suffers hardly deformation of an outer case packed with the divided packages or which suffers hardly generation of a large space in the outer case, even if changing ambient temperature.

Still another object of the present invention is to provide a divided package in which the adsorptivity of the adsorbent packed can be kept in spite of changes in ambient temperature.

In a first aspect of the present invention, there is provided a divided package of a medicinal adsorbent for internal use, comprising a divided package bag and an adsorbent for internal use which releases air at from 1.3 to 10 ml based on one gram of the adsorbent on heating from 10° C. to 30° C. and is packed therein, and having a volume expansion coefficient from 0 to 0.064 ml/°C.·g (adsorbent for internal use) at a temperature from 10° to 30° C.

In a second aspect of the present invention, there is provided a process for producing the divided package of the adsorbent for internal use, which comprises (a) filling an adsorbent for internal use, which is heated to a temperature ranging from a 5° C. higher temperature than room temperature to 300° C., in a divided package bag and then sealing the divided package bag, or (b) filling an adsorbent for internal use in a divided package bag and then sealing the divided package bag under a pressure below atmospheric pressure.

DETAILED DESCRIPTION OF THE INVENTION

Figure 1:
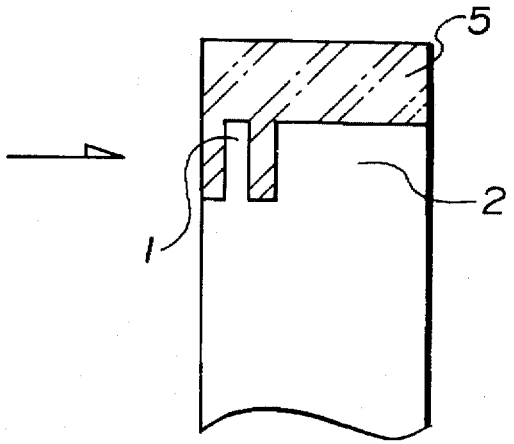
FIG. 1 is a schematic view of an example of divided package in which a seal portion is so designed that there is formed a small opening for inflow of air when the divided package is ripped open.

The adsorbent for internal use in the present invention may be of any type as far as it is capable of adsorbing and releasing air by the change of ambient temperature during storage. For example, the adsorbent used in the present invention is the one which can release air contained therein at a rate from 1.3 to 10 ml based on one gram of the adsorbent on heating from 10° C. to 30° C. The amount of air released was determined in the following way.

The adsorbent is filled in a moisture-proof package bag and then is heat-sealed to obtain a divided package packing the adsorbent. The divided package obtained is fixed to the inner wall of a measuring cylinder. Liquid paraffin is added into the cylinder so that the divided package is entirely immersed in liquid paraffin. The measuring cylinder is fixed in a 10° C. thermostat, and the scale of the liquid level is read. Then the temperature of the thermostat is raised to 30° C. and the increment of the liquid level is read. Volume expansion of liquid paraffin itself that occurred during heating from 10° C. to 30° C. is deducted from the increment above. The obtained deduction is divided by the weight of the adsorbent. The obtained value is here given as the amount of air released based on one gram of the adsorbent.

Examples of the adsorbents which meet the above requirement are charcoal, active carbon, spherical carbonaceous adsorbent, oxides and hydroxides of aluminum, iron, titanium, silicon and the like, hydroxyapatite, etc., which are usable as medicine.

The especially preferred adsorbent for use in the present invention is spherical carbonaceous adsorbent such as disclosed in JP-B-62-11611 and U.S. Pat. No. 4,681,764. The spherical carbonaceous adsorbent disclosed in the above patents is a porous spherical carbonaceous product having a particle diameter of from 0.05 to 1 mm, a specific pore volume of the spherical particles having a pore radius of not more than 80 Å of from 0.2 to 1.0 ml/g and possessing both acidic and basic groups. The preferred amount ranges of the acidic and basic groups are as follows: total acidic group (A)=0.30–1.20 meq/g;. total basic group (B)=0.20–0.70 meq/g; A/B=0.40–2.5. The total acidic group (A) and the total basic group (B) are determined by the conventional method as described below.

(a) Total acidic group (A):

After adding 1 g of spherical adsorbent carbon pulverized to a size less than 200 mesh into 50 ml of a 0.05N NaOH solution and shaking the mixture for 48 hours, the spherical adsorbent carbon is filtered out and the obtained filtrate is neutralized by titration. The amount of A groups is represented by the amount of the consumed NaOH which is determined by neutralization titration.

(b) Total basic group (B):

After adding 1 g of spherical adsorbent carbon pulverized to a size less than 200 mesh into 50 ml of a 0.05N HCl solution and shaking the mixture for 24 hours, the spherical adsorbent carbon is filtered out and the obtained filtrate is neutralized by titration. The amount of B groups is represented by the amount of consumed HCl which is determined by neutralization titration.

In case the above spherical carbonaceous adsorbent is used as a therapeutic agent for the liver- and kidney-diseases, its dosage depends on the subject (animal or man), age, individual difference, condition of the disease and other factors. In the case of man, for example, the oral dose is usually from 1 to 10 g per day. This quantity may be given at one time or in 2 to 4 portions. In certain cases, this daily dose may be properly increased or decreased. Therefore, the above-defined daily dose of adsorbent or one integer parts thereof, e.g., 0.1–10 g of adsorbent is packed in a divided package bag. If necessary, vitamin(s), adjuvant, lubricant and/or other medicine(s) may be added to the said dose of adsorbent.

For taking a dose of adsorbent, the patient rips open a divided package, puts the adsorbent therein into his mouth and swallows it with water or other suitable drink. The adsorbent may be suspended in water or other suitable drink such as juice before taking it.

Any process of producing the divided package of an adsorbent for oral administration of the present invention may be used as long as, by that process, the divided package having a volume expansion coefficient of from 0 to 0.064 ml/°C.·g (adsorbent for internal use) at a temperature from 10° to 30° C. can be produced. The following methods, (A) and (B), may be exemplified as widely usable processes.

(A) An adsorbent for internal use having a temperature ranging from a 5° C. higher temperature than room temperature to 300° C. is filled in a divided package bag and then the divided package bag is sealed. The lower threshold temperature of the adsorbent is preferably a 10° C. higher temperature than room temperature, more preferably a 15° C. higher temperature than room temperature. The upper threshold temperature is preferably 200° C., more preferably 130° C. That is, the temperature range of the adsorbent is preferably from a 10° C. higher temperature than room temperature to 200° C., more preferably from a 15° C. higher temperature than room temperature to 130° C.

(B) An adsorbent for internal use is filled in a divided package bag and then the divided package is sealed under a pressure below atmospheric pressure.

A combination method of (A) and (B) may be another process. For example, the adsorbent for internal use having a temperature ranging from a higher temperature than room temperature to 300° C. is filled in a divided package bag and then the divided package bag is sealed under a pressure below atmospheric pressure. In this case, since the combination method of (A) and (B) is used in the packing process, it may not be necessary that the adsorbent temperature at filling is 5° C. higher temperature than room temperature. Further, a process which comprises filling in a divided package bag an adsorbent for internal use having a temperature ranging from a higher temperature than room temperature to 300° C. under a pressure below atmospheric pressure and then sealing the divided package bag under the same condition, may be exemplified.

In the process (A), "room temperature" means the temperature at the site of packing. According to the Japanese Pharmacopoeia, the room temperature is defined from 1° to 30° C. The expression "adsorbent for internal use having a temperature ranging from a 5° C. higher temperature than room temperature to 300° C." at the time of packing means that, for instance, when the room temperature at the packing site is 15° C., the temperature of the adsorbent at the time of packing is 20° to 300° C., and when the room temperature of the packing site is 30° C., the temperature of the adsorbent at the time of packing is 35° to 300° C.

If the temperature of the adsorbent for internal use at the time of packing is below a 5° C. higher temperature than room temperature, the adsorbent in the divided package becomes mobile when cooled to room temperature, and the divided package is deformed largely by a change in amount of air contained in the adsorbent with variation of ambient temperature. In contrast with this, when the temperature of the adsorbent at the time of packing is in the range from a 5° C. higher temperature than room temperature to 300° C., as air in the divided package is included in the adsorbent until the adsorbent is cooled down to room temperature after sealing, the pressure in the divided package lowers to cause rapid shrinkage of the divided package, thereby making the adsorbent immobile when cooled to room temperature. Thus, the divided package is scarcely deformed by a temperature change around room temperature. If the temperature of the adsorbent at the time of packing exceeds 300° C., the inner layer of the divided package is softened to impair appearance of the divided package.

The divided package obtained by packing with an adsorbent of a temperature ranging from a 5° C. higher temperature than room temperature to 300° C. described above is suited for short-time (several months) storage. For storage for a longer period of time, the temperature of the adsorbent to be packed is preferably 30° C. to 300° C., more preferably 35° C. to 200° C., still more preferably 40° C. to 130° C.

The volume expansion coefficient of the divided package is used as an index of deformation of the divided package of the present invention. The volume expansion coefficient is the value [ml/°C.·g (adsorbent for internal use)] calculated from the amount of volume expansion which takes place in heating from 10° C. to 30° C. That value ranges from 0 to 0.064 ml/°C.·g (adsorbent for internal use), preferably from 0 to 0.045 ml/°C.·g (adsorbent for internal use). The volume expansion coefficient of the divided package is determined in the following way.

The divided package of the present invention is fixed to the inner wall of a measuring cylinder with adhesive cellophane tape. Liquid paraffin is poured into the cylinder so that the divided package is entirely immersed in liquid paraffin. The volume increment in heating from 10° C. to 30° C. is read from the scale of the measuring cylinder. The volume expansion of liquid paraffin itself is deducted from the volume increment of the divided package packed with the adsorbent for internal use. The obtained deduction is divided by "(weight of the adsorbent)×20" to determine the volume expansion coefficient [ml/°C.·g (adsorbent for internal use)] of the divided package.

In the process (B), "pressure" means a pressure at the time of sealing in vacuum packing or evacuation packing. When sealing is performed under a packing pressure below atmospheric pressure, the volume expansion coefficient of the divided package falls within the range from 0 to 0.064 ml/°C.·g (adsorbent). The volume expansion coefficient ranges preferably from 0 to 0.045 ml/°C.·g (adsorbent). The divided package having the above-mentioned range of volume expansion coefficient suffers hardly deformation with change of ambient temperature. The means of "below atmospheric pressure" is a pressure whose air is evacuated under the atmospheric pressure or a pressure less than atmospheric pressure. The "atmospheric pressure" in the present invention means a pressure at the time of the packing and sealing. The pressure less than atmospheric pressure is preferably 40 to 740 mmHg, more preferably 120 to 680 mmHg, still more preferably 260 to 650 mmHg. As for means of packing, any known method of vacuum packing conducted under a pressure below atmospheric pressure can be employed. Under the atmospheric pressure, an evacuation packing may be employed. This is a method in which the interior of the divided package is evacuated by mechanical means, immediately followed by sealing. Evacuation of air can be effected by mechanical means, hydraulic means, or by drawing or squeezing the divided package by hands.

The internal pressure of the divided package of the present invention is preferably 40 to 740 mmHg, more preferably 120 to 680 mmHg, still more preferably 260 to 650 mmHg. The volume expansion coefficient in the temperature range from 10° to 30° C. of the divided package having the said range of internal pressure is within the range from 0 to 0.064 ml/°C.·g (adsorbent).

With the divided package of the present invention, it may happen that when the divided package is ripped open, the adsorbent packed therein is scattered away by rapid inflow of a large volume of air. This problem can be solved by providing a seal portion designed such that a small hole(s) for inflow of air can be first formed when the divided package is ripped open. This arrangement may be incorporated, if necessary.

FIGS. 1 to 6 show the examples of constitution of seal portion of a stick-like divided package. A similar seal portion may be provided for a three-side seal package, four-side seal package or package with bottom.

Figure 2:
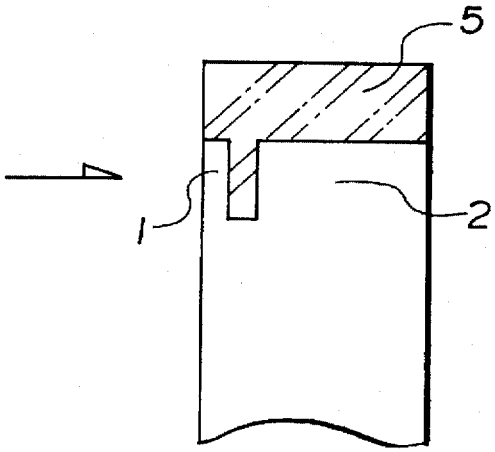
FIG. 2 is a schematic view of another example of divided package in which a seal portion is so designed that there is formed a small opening for inflow of air when the divided package is ripped open.
Figure 3:
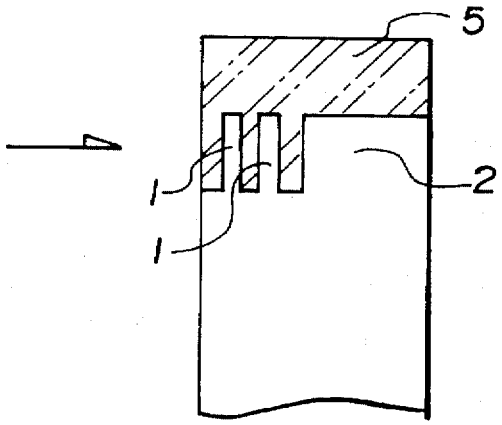
FIG. 3 is a schematic view of still another example of divided package in which a seal portion is so designed that there is formed a small opening for inflow of air when the divided package is ripped open.

In the embodiment of FIG. 1, when the seal portion is ripped open in the direction of arrow, there is at first formed a small opening 1 that allows inflow of air, and when the interior of the divided package has restored normal pressure, the adsorbent discharge end 2 is opened, so that there is no possibility of the adsorbent being scattered on opening of the divided package. In the embodiment of FIG. 2, the outside one of the small opening-forming seal of FIG. 1 is omitted. The embodiment of FIG. 3 is so designed that two small openings 1 are formed when the seal portion is ripped open. The seal portion may be designed so that three or even a greater number of small openings can be formed. The size of the small opening in FIGS. 1 to 3 ranges preferably from 0.1 to 2 mm, more preferably from 0.2 to 1 mm in diameter.

Figure 4:
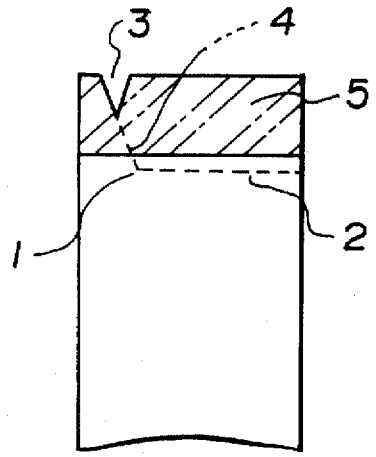
FIG. 4 is a schematic view of further example of divided package in which a seal portion is so designed that there is formed a small opening for inflow of air when the divided package is ripped open.
Figure 5:
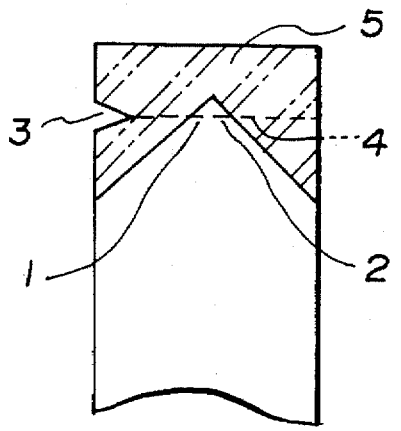
FIG. 5 is a schematic view of still further example of divided package in which a seal portion is so designed that there is formed a small opening for inflow of air when the divided package is ripped open.
Figure 6:
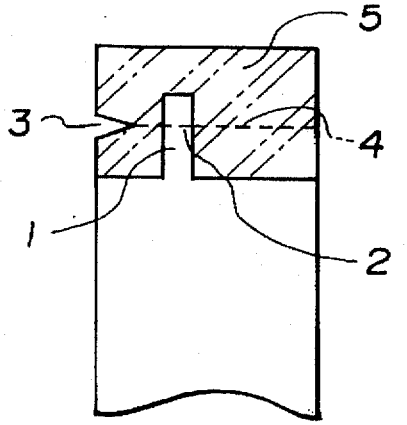
FIG. 6 is a schematic view of still more further example of divided package in which a seal portion is so designed that there is formed a small opening for inflow of air when the divided package is ripped open.

FIG. 4 shows an embodiment where a notch 3 and a perforation 4 are formed. In this case, when the divided package is ripped open from the notch 3, there is first formed a small opening 1 for admitting air into the divided package. As normal pressure is restored in the inside of the divided package, it is cut along the perforation 4 to its end to form the adsorbent discharge opening 2. Thus, the adsorbent won't be scattered on opening of the divided package. The embodiments of FIGS. 5 and 6 are designed so that the small opening 1 for inflow of air can concurrently serve as the adsorbent outlet 2. Since the aggregate of spherical carbonaceous adsorbent granules or powders has high fluidity, it can be taken out even from such a small opening.

As for the material for the divided package of the present invention, it is possible to use any type of material which is applicable to medicinal containers. Examples of such material are paper, plastics, metals such as aluminum foil, and composites of these materials.

The adsorbent for internal use in the present invention may lower in its adsorptivity with time when left in the atmospheric air. Tight packaging of the adsorbent, however, can maintain its adsorptivity. For safe preservation of adsorptivity, it is preferable to use a divided package made of a tight packaging material having excellent moisture resistance and gas barrier properties. It is possible to make primary packaging by using paper or cellophane through which air and moisture can pass relatively easily, followed by secondary packaging using a moisture-proof packaging material (multiple packaging). In such multiple package, however, because of rapid volume expansion or shrinkage by air contained in the adsorbent, deformation of the primary package with change of ambient temperature is unavoidable even when using paper or the like material which allows relatively easy passage of air and moisture. In this case, therefore, it is necessary to adopt means which can prevent deformation of the divided package, too.

The tight packaging material used in the present invention is a material which does not allow passage of air and moisture in the ordinary treatments. It is a material with a moisture permeability ranging preferably from 0 to 20 $g/m^2 \cdot 24$ hr, more preferably from 0 to 5 $g/m^2 \cdot 24$ hr. Moisture permeability was determined according to JIS Z0208 [Moisture permeability testing method (cup method) for moisture-proof packaging materials] under the conditions of 40° C. and 90% RH.

In practical use of a divided package made of a tight packaging material, the problem may happen that it is difficult to take out the adsorbent from the divided package because of electrostatic adhesion of the adsorbent to the cut edge and inner wall of the divided package. Such problem of static adhesion, however, scarcely occurs in the case of a divided package made of a packaging material having an aluminum layer.

In case a glassine or cellophane, or a plastic film having a tear direction property is laminated on the outer layer, there is an advantage that the divided package can be easily ripped open with fingers without aid of a perforation or notch, or without scissors.

The thickness of the film of packaging material used for the divided package of the present invention is preferably in the range from 10 to 500 μm, more preferably from 20 to 300 μm.

The shape and size of the divided package can be arbitrarily selected according to the amount of the adsorbent packed and the amount of the additive(s). The preferred types of divided package are stick-like divided package, three- or four-side seal divided package and divided package with bottom which can pack a dose of adsorbent or one integer parts thereof, e.g., 0.1 to 10 g of adsorbent.

Tensile strength of the divided package material ranges preferably from 0.1 to 30 kgf/15 mm width, more preferably from 0.2 to 15 kgf/15 mm width. Tensile Strength was determined according to JIS Z 1707 [Plastic food packaging films].

The divided package of the present invention is made of a single-layered film or a multilayered film.

As materials usable for single-layered film, papers, plastics and metals can be used. As the plastic materials for the single-layered film, polyethylene, polypropylene, ethylene-propylene copolymer, polyvinyl acetate, vinyl chloride-vinyl acetate copolymer, polyvinylidene chloride, ethylene-acryl alkylate copolymer, polybutadiene, polyesters, hydroxybenzoic acid polyesters, poly-4-methylpentene-1, polychlorotrifluoroethylene, polycarbonates, polyetherimides, polyarylates, etc. may be exemplified.

The thickness of the single-layered film ranges from 10 to 500 μm, preferably from 20 to 300 μm.

As the multilayered film of the present invention, a film having a paper layer, a cellophane layer, an aluminum layer, a silica layer, a polyester layer, a polyvinylidene chloride layer, a vinylidene chloride copolymer layer, a polychlorotrifluoroethylene layer, an ethylene-vinyl alcohol copolymer layer, a polyvinyl alcohol layer, a polyacrylonitrile layer, a cellulose layer, a polystyrene layer, a polycarbonate layer, a polyethylene layer, a polypropylene layer, a polyester layer, a nylon layer, a hydroxybenzoic acid polymer layer, a poly-4-methylpentene-1 layer, a polyetherimide layer, a polyarylate layer, or a polyvinyl chloride layer can be exemplified.

The multilayered film is preferred to the single-layered film as the former has better workability and is more advantageous in terms of moisture resistance. A multilayered film having a polyvinylidene chloride layer, a polychlorotrifluoroethylene layer or an aluminum layer is preferred. A multilayered film having an aluminum layer is especially preferred.

A preferred example of multilayered film of the present invention comprises (1) an outer layer composed of plastics film, cellophanes, papers, or the like having a high modulus of elasticity and good dimensional stability, (2) an intermediate layer composed of a gas barrier plastic film or aluminum layer having excellent gas barrier properties and moisture resistance, and (3) an inner layer composed of a sealant layer capable of heat sealing or ultrasonic sealing. In the case of a film whose intermediate layer has a high modulus of elasticity and good dimensional stability, the outer layer may be a plastic coating layer. Further, a plastic film, a plastic coating layer, a cellophane layer, a paper layer may be formed between each layer. Also, the outer layer or the intermediate layer may be omitted depending on the purpose of use of the film. Also, the sealant layer is formed on the entirety of the inner surface or at the seal portion alone. There may be applied a sealant layer having a plurality of small holes. It is also possible to form a divided package by using an ordinary adhesive instead of a sealant layer.

The thickness of the multilayered film ranges from 10 to 500 μm, preferably from 20 to 300 μm.

As the materials usable for forming the plastic film constituting the outer layer and the plastic film or plastic coating layer laminated, if necessary, between each said layer of the multilayered film, polyesters, polyvinylidene chloride, polyvinyl chloride, ethylene-vinyl alcohol copolymer, ethylene-vinyl acetate copolymer, oriented polypropylene, polypropylene, oriented polyethylene, high-density polyethylene, low-density polyethylene, ethylene-acryl alkylate copolymer, polychlorotrifluoroethylene, Teflon, polyvinyl alcohol, polyacrylonitrile, cellulose, polystyrene, polycarbonates and nylons may be exemplified. Among these materials, polyesters, polyvinylidene chloride, oriented polypropylene, polypropylene, oriented polyethylene, high-density polyethylene, and low-density polyethylene are preferred.

For packing at high temperature, it is recommended to use a heat-resistant polymer such as hydroxybenzoic acid polyester, polypropylene, poly-4-methylpentene-1, polyester, polycarbonate, polyetherimide, polyarylate, and the like as the material of the outer layer.

Examples of the papers usable in the laminated film of the present invention include glassine, translucent glassine, coated wrap paper, slick paper, imitation Japanese vellum, cellophane, sulfate paper, and the like. Among them, glassine, translucent glassine, and coated wrap paper are especially preferred.

As the intermediate layer with excellent gas barrier properties and moisture resistance, an aluminum layer such as an aluminum foil and an aluminum deposited layer, a polychlorotrifluoroethylene layer, a polyvinylidene chloride layer, a vinylidene chloride copolymer layer, an ethylene-vinyl alcohol copolymer layer, a silica deposited layer, and the like can be used. Among them, an aluminum layer, a polychlorotrifluoroethylene layer, a polyvinylidene chloride layer, and an ethylene-vinyl alcohol copolymer layer are preferred. An aluminum layer is especially preferred.

As the materials usable for forming the sealant layer, oriented polyethylene, high-density polyethylene, low-density polyethylene, polypropylene, ethylene-propylene copolymer, polyvinyl acetate, vinyl chloride-vinyl acetate copolymer, polyvinylidene chloride, ethylene-acryl alkylate copolymer, polybutadiene, polyesters, hydroxybenzoic acid polyesters, poly-4-methylpentene-1, polycarbonates, polyetherimides, polyarylates, and ester based copolymers may be exemplified. Among them, polyvinylidene chloride, oriented polyethylene, high-density polyethylene, low-density polyethylene, and ethylene-acryl alkylate copolymer are preferred.

For high-temperature packing, it is recommended to use a heat-resistant polymer such as hydroxybenzoic acid polyester, polypropylene, poly-4-methylpentene-1, polyester, polycarbonate, polyetherimide and polyarylate. Among them, hydroxybenzoic acid polyester, and polyetherimide are preferred.

The packaging materials shown above are suited as a non-multiple packaging material or as a outer layer material of a multiple package.

Preferred examples of the materials composed of the respective layers of the multilayered film having an aluminum layer are as follows:

Outer layer (10 to 150 μm): glassine, translucent glassine, coated wrap paper, cellophane, polyester, polyethylene, slick paper, or heat-resistant polymer;

Intermediate layer (5 to 50 μm): aluminum layer (foil or deposited layer);

Inner layer (sealant layer) (2 to 150 μm): polyvinylidene chloride, polyethylene, ethylene-acryl alkylate copolymer, or heat-resistant polymer.

If necessary, an ethylene-vinyl acetate copolymer layer or a polyethylene layer may be provided as an adhesive layer between each said layers.

Preferred examples of package having no aluminum layer are shown below.

| Constitution (figures are thickness, μm) | Moisture permeability ($g/m^2 \cdot 24$ hr) |
|---|---|
| PVC100/PVDC50/LDPE30/PVDC50/PVC100 | 0.2 |
| PVC70/oriented polyolefin100/PVC70 | 0.8 ± 0.2 |
| PVDC-coated PET/PE (special) | <1 |
| OPP20/OHDPE45/LDPE30 | 1 |
| PET12/LDPE15/CPP25 | 1 |
| PVDC-coated CPP/PE | 1–3 |
| PVDC30/PVC230 | 1.1 ± 0.1 |
| PVC200/PVDC16/CPP100 | 1.3 ± 0.1 |
| PVDC1.5/OEVAL12/PVDC1.5/LDPE15/OHDPE25 | 1.5 ± 0.5 |
| PVDC12-coated PET24/EVA60 | 2.0 |
| HDPE/J2/PE | 2–3 |
| PVDC12-coated cellophane32/LDPE40 | 2.5 |
| OPE30/PVDC15/OEVAL12/PVDC15/LDPE40 | 2.5 ± 0.5 |
| PT20/PVDC10/LDPE40 | 3.0 ± 0.5 |
| PVDC3-coated OPVA15/LDPE70 | 5 |

-continued

| Constitution (figures are thickness, μm) | Moisture permeability ($g/m^2 \cdot 24$ hr) |
|---|---|
| PVDC3-coated OPP23/LDPE40 | 5 |
| OPP20/EVAL15/LDPE40 | 5 |
| CPP/mono-oriented PVDC-coated cellophane/CPP | 5–7 |
| CPP/PE | 5–10 |
| CPP20/CPP30 | 6 |
| CPP/PT cellophane/CPP | 6–8 |
| HDPE/PT cellophane/PE | 6–8 |
| PVC/PE | 6–10 |
| PVDC-coated cellophane23/LDPE50 | 7 ± 1 |
| PT Cellophane/PP | 7–8 |
| PVDC3-coated PET15/CPP50 | 8 |
| PVDC3-coated cellophane23/LDPE40 | 10 |
| PET12/LDPE15/CPP25 | 10 |
| Glassine/PE/PVDC | 10–12 |
| PT cellophane20/LDPE50 | 11 ± 1 |
| PT cellophane/PE | 12 |
| PET/PE | 12 |
| Glassine/PE | >12 |
| Slick paper/PE | >12 |
| PVDC3-coated ONylon18/EVA50 | 13 |
| ONylon15/EVAL15/EVA50 | 14 |
| Cellophane20/LDPE40 | 15 |
| ONylon15/LDPE40 | 15 |

[Quoted from N. Hayashi and H. Miura: Development of Medicines,. Vol. 12, Formulation Materials 2, pp. 475–536, 1990, Hirokawa Shoten, Tokyo.]
(Notes)
PVC: unplasticized polyvinyl chloride
PVDC: polyvinylidene chloride
LDPE: low-density polyethylene
PE: polyethylene
OPP: oriented polypropylene
Oriented HDPE: oriented high-density polyethylene
PET: oriented polyester
CPP: copolymer type polypropylene
OEVAL: oriented ethylene-vinyl alcohol copolymer
OHDPE: oriented high-density polyethylene
EVA: ethylene-vinyl acetate copolymer
J2: a kind of cellophane (produced by Fujimori Kogyo K.K.)
OPE: oriented PE
PT: plane type
EVAL: ethylene-vinyl alcohol copolymer
PP: polypropylene
ONylon: oriented nylon
OPVA: oriented polyvinyl alcohol The divided package of an adsorbent for internal use according to the present invention is substantially proof against deformation due to change of the amount of air contained in the adsorbent. This eliminates troubles resulting from volume change of the divided package in casing, storage and transport of the adsorbent packed therein. In case the material of the divided package is an air-tight packaging material, adsorptivity of the adsorbent is maintained.

EXAMPLES

The following examples further illustrate the present invention. It is to be understood, however, that these examples are merely intended to be illustrative and not to be construed as limiting the scope of the invention in any way.

Referential Example 1: Preparation of adsorbent for internal use

A spherical carbonaceous adsorbent (sample 1; particle size: 0.05–1.0 mm; specific pore volume of spherical adsorbent of pore radius of not more than 80 Å: 0.70 ml/g) was obtained according to Example 1 of JP-B-6211611 (U.S. Pat. No. 4,681,764). Sample 1 releases 1.46 ml of air based on one gram of adsorbent on heating from 10° C. to 30° C. In an acute toxicity test conducted by orally administering the adsorbent to JCL-SD rats, no abnormality was observed even at the maximum dose (18,000 mg/kg for female rats and 16,000 mg/kg for male rats).

Example 1 and Comparative Example 1

The stick-like divided packages (8 cm long and 2 cm wide, exclusive of the seal portion) composed of the following five types of multilayered film were used.

| Constitution of multilayered film | Thickness (μm) | Moisture permeability ($g/m^2 \cdot 24$ hr) |
|---|---|---|
| a. glassine(28)/PE(15)/AL(7)/PE(20)/PVDC(4) | 74 | ≦0.1 |
| b. translucent glassine(28)/PE(15)/AL(9)/PE(40) | 92 | ≦0.1 |
| c. slick paper(62)/PE(15) | 77 | 11.1 |
| d. PET(12)/perforation/PE(15)/AL(9)/EAA(40)/PVDC(4) | 80 | ≦0.1 |
| e. PET(12)/perforation/PE(15)/AL(9)/PE (20)/PE (30) | 86 | ≦0.1 |

(PE: polyethylene; AL: aluminum foil; PVDC: polyvinylidene chloride; PET: polyester; EAA: ethylene-acryl alkylate copolymer. Perforation was provided in the PET layer at the position within about 1 cm below the top seal of the stick-like divided package.)

Divided packages were made by using a stick packer SP-135P-4MH (mfd. by Komatsu Corp.). One gram of sample 1 was packed in each divided package and then heat-sealed to obtain a divided package packed. Room temperature was 15° C.

The temperature of sample 1 when packed in the divided package was from 0° to 10° C. (Comparative Example 1), from 20° to 25° C. (Example 1a) and from 50° to 70° C. (Example 1b). After sealed, each divided package packed was left at room temperature and change of its appearance was observed. Also, each divided package was ripped open with fingers to see easiness of tearing.

All divided packages in Comparative Example 1, wherein the temperature of the adsorbent to be packed was from 0° to 10° C., didn't shrink after packed, allowing movement of the adsorbent in the divided package. All divided packages in Example 1a, wherein the temperature of the adsorbent to be packed was from 20° to 25° C. shrank after packed, making the adsorbent therein immobile. When the divided packages in Example 1a was held by hand, it was gradually expanded by body temperature, making the adsorbent in the divided package mobile. All divided packages in Example 1b, wherein the temperature of the adsorbent to be packed was from 50° to 70° C., shrank rapidly in about one minute after packed and the adsorbent therein became perfectly immobile. It would not be deformed even when left at a temperature around body temperature.

The divided package with any of the said film constitutions could be easily ripped open. However, in the case of the film constitutions d and e, it was difficult to rip open the divided package without perforation.

With temperature variation from 10° C. to 30° C., there was observed a change of volume of the divided package when the temperature of the adsorbent to be filled was from 0° to 10° C. (Comparative Example 1), but substantially no change of volume was observed when the temperature of the adsorbent to be filled was from 20° to 25° C. (Example 1a) or the temperature of the adsorbent to be filled was from 50° to 70° C. (Example 1b).

Example 2

The stick-like divided packages made of the film constitution a were used to obtain the packed divided packages.

The divided packages obtained by packing sample 1 of a temperature (130° C.) shrank rapidly when left at room temperature after packing (Example 2a).

By using a multilayered film having a sealant layer made of a heat-resistant polymer of hydroxybenzoic acid polyester (PET/AL/hydroxybenzoic acid polyester), a divided package was obtained by packing sample 1 of a temperature (250° C.). This divided package shrank rapidly when left at room temperature after packing (Example 2b).

Further, by using a multilayered film having a sealant layer made of a heat-resistant polymer of polyetherimide (polyetherimide/AL/polyetherimide), a divided package was obtained by packing sample 1 of a temperature (300° C.). This divided package also shrank rapidly when left at room temperature after packing (Example 2c).

Each of the divided packages had good appearance, and there was admitted no sign of softening of the inner layer. Also, with temperature variation around room temperature, for example, from 10° C. to 30° C., there was not observed the change of volume in the said divided packages at all.

Example 3

The divided packages were made according to Example 1 by using the film constitution a and e and packing the adsorbent (sample 1) of the temperatures of 0° to 10° C., 20° to 25° C. and 50° to 70° C., and the amount of volume expansion of each divided package at the temperatures of 10° C., 20° C. and 30° C. was measured. The measurement was made in the following way.

The three divided packages obtained under the same conditions of Example 1 were fixed to the inner wall of a measuring cylinder (100 ml) with a cellophane adhesive tape. Liquid paraffin was added into the cylinder so that the divided packages would be entirely immersed in liquid paraffin. The increments of volume ($\Delta V$) at the respective temperatures against the volume (70 ml) at 10° C. were read from the scale of the measuring cylinder. Meanwhile, liquid paraffin (70 ml at 10° C.) was put into a measuring cylinder and the amounts of volume expansion of liquid paraffin ($\Delta V0$) at the respective temperatures were measured. The amount of volume expansion per divided package (ml/divided package)($\Delta v$) was calculated: $\Delta v=(\Delta V-\Delta V0)/3$. The results are shown in Table 1. It was found that when the temperature of the samples was from 20° to 25° C. or from 50° to 70° C., the amount of volume expansion around room temperature (15° C.) was 0 or close to 0. Also, the volume expansion coefficient of divided package was calculated from the amount of volume expansion of divided package in temperature change from 10° C. to 30° C. as follow:

Volume expansion coefficient=$\Delta v$ at 30° C./2(g)×20 (°C.)

The volume expansion coefficient was below 0.064 ml/°C.·g (adsorbent) when the temperature of the adsorbent filled was from 20° to 25° C. or from 50° to 70° C. However, the volume expansion coefficient exceeded 0.064 ml/°C.·g (adsorbent) when the temperature of the adsorbent filled was from 0° to 10° C.

The amount of volume expansion of an empty divided package obtained according to Example 1 by using the film constitution a without sample 1, at the atmospheric temperature from 0° to 10° C., is shown in Table 1. It is evident that the deformation of the divided package packed with an adsorbent is due to change in amount of air contained in the adsorbent. Also, at temperature variation around room temperature, for example, from 10° to 30° C., there was not almost observed the volume change of the divided package obtained by filling the adsorbent of a temperature of from 20° to 25° C. or from 50° to 70° C.

TABLE 1

| Film constitution | Adsorbent temp. (°C.) | Volume divided 10° C. | Expansion package) 20° C. | (ml/ at: 30° C. | Volume expansion coefficient (ml/°C. · g) |
|---|---|---|---|---|---|
| a | 0–10 | 0 | 0.53 | 2.93 | 0.073 |
| | 20–25 | 0 | 0.03 | 0.53 | 0.013 |
| | 50–70 | 0 | 0.03 | 0.00 | 0.000 |
| e | 0–10 | 0 | 0.17 | 2.60 | 0.065 |
| | 20–25 | 0 | 0.00 | 0.93 | 0.023 |
| | 50–70 | 0 | 0.00 | 0.00 | 0.000 |
| a | 0–10 (empty) | 0 | 0.00 | 0.00 | — |

Example 4

Divided packages were obtained according to Example 1 by using the film constitution a. The divided packages were cut open with scissor. The adsorbent was heated at 60° C. and filled in the divided package bag. The open side of the divided package bag was heat-sealed by using the molds that would give the seal portion of the designs shown in FIGS. 1–6, to obtain a divided package. When left at room temperature, the divided packages shrank, thereby making the adsorbent therein immobile. When the divided packages were ripped open, since a small opening(s) to allow inflow of air was first formed, no scatter of the adsorbent occurred on opening the divided package. On the other hand, in the case of the divided packages made and packed under the same conditions as in Example 1 without their seal portion designed to form a small opening when ripped open, scatter of the adsorbent could occur on opening of the divided package. Also, at temperature variation around room temperature, for example, from 10° C. to 30° C., there was observed substantially no change of volume of the divided package.

Example 5 and Comparative Example 2

Vacuum packaging was carried out at room temperature by using the film constitution a and e shown in Example 1. Each packaging material was cut into a 20 cm square sheet and the sheet was folded in two. Two of the three sides except the fold were heat-sealed with a heat sealer to form a bag. The divided package were obtained by the following way. A spherical carbonaceous adsorbent (10 g) (sample 1) was placed in this bag, and the open side thereof was heat-sealed by a gas packing heat sealer, Model FG-400E-NG-10W (Fuji Impulse Co., Ltd.) under a pressure of 700 mmHg or 500 mmHg. The divided package of Comparative Example 2 was heat-sealed in the ordinary way under atmospheric pressure. The volume expansion coefficients of these adsorbent-packed divided packages were determined in the following way.

The divided package of the present invention was fixed to the inner wall of a measuring cylinder (200 ml) with cellophane adhesive tape. Then liquid paraffin (150 ml) was added into the cylinder so that the divided package would be entirely immersed in liquid paraffin. The volume increment by changing temperature from 10° C. to 30° C. was read from the scale of the measuring cylinder. Meanwhile, the amount of volume expansion of liquid paraffin itself was measured and deducted from the previously determined volume increment, and the obtained deduction was divided by 10 (g)×20 (°C.) to calculate the volume expansion coefficient [ml/°C.·g (adsorbent)] of the divided package. The results are shown in Table 2.

The volume expansion coefficients of the divided packages sealed under a pressure of 700 mmHg or 500 mmHg were less than 0.064 ml/°C.·g (adsorbent), whereas the volume expansion coefficients of the divided packages sealed under atmospheric pressure in Comparative Example 2 exceeded 0.064 ml/°C.·g (adsorbent). Also, the divided package of Example 5 had substantially no change of volume with temperature variation around room temperature, for example, from 10° C. to 30° C.

TABLE 2

| Film constitution | Pressure (mmHg) | Volume expansion coefficient [ml/°C. · g (adsorbent)] |
|---|---|---|
| a | 760 | 0.066 |
| | 700 | 0.023 |
| | 500 | 0.000 |
| e | 760 | 0.070 |
| | 700 | 0.019 |
| | 500 | 0.003 |

Example 6 and Comparative Example 3

The adsorbent-packed divided packages were obtained by conducting evacuation packaging at room temperature under atmospheric pressure. That is, 2 g of a spherical carbonaceous adsorbent (sample 1) was placed in each divided package (2×10 cm) made of the film constitution a shown in Example 1, and the divided package was drawn through hands to squeeze out air in the divided package, immediately followed by heat-sealing (using the heat sealer described in Example 5) (Example 6). The results of measurement of volume expansion coefficient with temperature change of the divided packages from 10° C. to 30° C. are shown in Table 3. The package of Comparative Example 3 was obtained without evacuation of air in the divided package..

TABLE 3

| | Volume expansion coefficient [ml/°C. · g (adsorbent)] |
|---|---|
| Example 6 | 0.044 |
| Comp. Example 3 | 0.065 |

Example 7

The internal pressures of the stick-like adsorbent-packed divided packages differing in sample temperature at the time of packing were determined. Two grams of sample 1 was filled in each of the stick-like divided package bags made of the film constitution a shown in Example 1, and each divided package was heat-sealed with the sample temperature at the time of filling which was adjusted to be 25° C. (room temperature), 30° C., 35° C., 45° C. or 65° C. An empty stick-like divided package made of the same material as the above divided packages was prepared as a control.

Three of adsorbent-packed divided packages in same packing temperature were fixed to the inner wall of a measuring cylinder (100 ml) in the same way as Example 3. Then liquid paraffin (25° C.) was added into the cylinder and the liquid surface was adjusted at the 70 ml mark. The cylinder was placed in the entry box of TE-her type ANAER-O-Box (Model ANX-1, mfd. by Hirasawa & Co., Ltd.), and the liquid level of liquid paraffin in the measuring cylinder was read. The pressure at this moment was 760 mmHg. Then a vacuum pump was operated and the scale at the liquid level of liquid paraffin under the pressures (750–430 mmHg) at intervals of 10 mmHg was read. This test was conducted three times with the divided packages packed by the same temperature, and the mean value of the scale readings of the liquid level of liquid paraffin was calculated. The mean value of said scale readings was plotted against drop of pressure, and the pressure at the moment immediately before the scale mark of the liquid level of liquid paraffin began to elevate was expressed here as internal pressure of the stick-like divided package. The results are shown in Table 4. There was observed no increase of volume of liquid paraffin alone under said pressures, so a correction was not needed.

TABLE 4

| Temperature of sample to be packed (°C.) | Internal pressure of divided package (mmHg) |
|---|---|
| 25 (control; empty) | 760 |
| 25 (room temp.) | 760 |
| 30 | 740 |
| 35 | 680 |
| 45 | 620 |
| 65 | 510 |

Comparing expansion coefficient against pressure reduction of the divided package packed with the sample at room temperature with that of the empty divided package as control, it is seen that the value of expansion coefficient (0.056 ml/mmHg) of the divided package packed is larger than that (0.025 ml/mmHg) of the control, indicating that sample 1 has included a fairly large amount of air.

Also, with temperature variation around room temperature, for example, from 10° C. to 30° C., the volume expansion coefficient of the divided package was not more than 0.064 ml/°C.·g (adsorbent for internal use) when the sample temperature was 30° C., 35° C., 45° C. and 65° C.

What is claimed is:

1. A divided package of a medicinal adsorbent for internal use, comprising a divided package bag and an adsorbent for internal use which releases air ranging from 1.3 to 10 ml based on one gram of the adsorbent on heating from 10° C. to 30° C. packed in said divided package bag, said package produced by the process of (a) filling a package bag with said adsorbent heated to a temperature ranging from 5° C. above room temperature up to 300° C. and thereafter (b) sealing the package, said divided package having a volume expansion coefficient ranging from 0 to 0.064 ml/°C.·g at a temperature of from 10° C. to 30° C., said divided package bag formed of a single-layered film or a multilayered film having a moisture permeability of 0 to 20 g/m$^2$·24 hr, said film composed of paper, plastics, metals, or composites thereof.

2. The divided package according to claim 1 wherein the package bag is filled at a temperature ranging from at least 10° C. above room temperature up to 200° C.

3. The divided package according to claim 1 wherein the package bag is filled at a temperature ranging from at least 15° C. above room temperature up to 130° C.

4. A divided package of a medicinal adsorbent for internal use, comprising a divided package bag and an adsorbent for internal use which releases air ranging from 1.3 to 10 ml based on one gram of the adsorbent on heating from 10° C. to 30° C. packed in said divided package bag, said package produced by the process of (a) filling a package bag with said adsorbent and thereafter (b) sealing the filled package below atmospheric pressure, said divided package having a volume expansion coefficient ranging from 0 to 0.064 ml/°C.·g at a temperature of from 10° C. to 30° C., said divided package bag formed of a single-layered film or a multilayered film having a moisture permeability of 0 to 20 $g/m^2 \cdot 24$ hr, said film composed of paper, plastics, metals, or composites thereof.

* * * * *